US006546347B2

(12) United States Patent
Batchelor et al.

(10) Patent No.: US 6,546,347 B2
(45) Date of Patent: Apr. 8, 2003

(54) METHOD AND APPARATUS FOR AUTOMATICALLY SETTING ROCKER ARM CLEARANCES IN AN INTERNAL COMBUSTION ENGINE

(75) Inventors: Graham P. Batchelor, Peterborough (GB); William M. Crozier, Peterborough (GB)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/943,615

(22) Filed: Aug. 30, 2001

(65) Prior Publication Data

US 2002/0077762 A1 Jun. 20, 2002

(30) Foreign Application Priority Data

Aug. 30, 2000 (GB) ..... 0021181

(51) Int. Cl.[7] ..... G01M 15/00; G06F 19/00
(52) U.S. Cl. ..... 702/94; 73/119 R; 123/90.16
(58) Field of Search ..... 702/85, 94, 150; 73/119 R; 123/90.16, 90.18, 90.23, 90.24

(56) References Cited

U.S. PATENT DOCUMENTS 6,205,850 B1 * 3/2001 Wehrman et al. ..... 73/119 R
6,340,010 B1 * 1/2002 Hara ..... 123/90.17

FOREIGN PATENT DOCUMENTS

| | | |
|---|---|---|
| GB | 448530 | 6/1936 |
| JP | 10240890 | 9/2000 |
| JP | 11202070 | 1/2001 |

* cited by examiner

*Primary Examiner*—John S. Hilten
*Assistant Examiner*—John Le
(74) *Attorney, Agent, or Firm*—John J Cheek

(57) ABSTRACT

A method for automatically setting valve clearances in internal combustion engines (also known as "tappet setting" or "valve lash setting") comprises a series of steps in which a rocker arm is set to a zero position that is recorded as a reference datum and an adjustment screw is then operated to set the rocker arm to a first reference position. The adjustment screw is then rotated through a predetermined angle so that the rocker arm is moved to a second reference position. The difference between the first and second reference positions and the predetermined angle are used to determine a coefficient relating the angular movement of the adjustment screw to linear movement of the rocker arm. The coefficient is then used to calculate the angular rotation of the adjustment screw required to set a predetermined valve clearance relative to the zero position. The initial adjustment of the rocker arm position serves to neutralize backlash in the valve drive train prior to setting the valve clearance. The method and associated apparatus may also be used to set the clearance between a rocker arm and other rocker arm actuated engine components.

16 Claims, 4 Drawing Sheets

METHOD AND APPARATUS FOR AUTOMATICALLY SETTING ROCKER ARM CLEARANCES IN AN INTERNAL COMBUSTION ENGINE

TECHNICAL FIELD

The present invention relates to an automated method for setting clearances between rocker arms and associated rocker arm actuated engine components, such as inlet and exhaust valves in the cylinder(s) of internal combustion engines.

BACKGROUND

As is well known in the art, the operation of inlet and exhaust valves in internal combustion engines is often controlled by a rocker arm that reciprocates about a rocker shaft. A first end of the rocker arm, located on a first side of the rocker shaft, is reciprocated by a push rod connected to a cam follower, which in turn is driven by a cam mounted on a camshaft. The second end of the rocker arm, located on the second side of the rocker shaft, drives the valve stem of an inlet or exhaust valve that is spring-biased into a normally closed position. Each inlet valve and each exhaust valve has an associated rocker arm. When the valves associated with a particular piston are fully closed (i.e. when the piston is in its top dead center (TDC) position on the compression stroke of a four stroke engine), a certain predetermined clearance is required between the second end of the rocker arm and the end of the valve stem which is contacted by the rocker arm in operation of the engine. This clearance must be set within fine tolerances, typically of the order of +/−2/1000 inch (0.051 mm). The process of setting this clearance is referred to herein as "valve clearance setting" and is commonly referred to in the art as "tappet setting" in the United Kingdom or "valve lash setting" in the USA.

The valve clearance is typically adjusted by means of a threaded adjustment screw that extends through the first end of the rocker arm and is seated in a cup formed in the end of the push rod. The adjustment screw may be locked in the required position by a lock nut, or may be a friction screw or the like which does not require a lock nut.

The combination of the cam, cam follower, push rod, adjustment screw, rocker arm and rocker shaft is referred to herein as the "valve drive train".

Conventionally, valve clearances are adjusted manually, by use of a feeler gauge which is inserted between the second end of the rocker arm and the end of the valve stem whilst manually adjusting the adjustment screw at the first end of the rocker arm. This process is labor intensive, time consuming and relatively inaccurate/inconsistent. It would clearly be desirable to automate the process of valve clearance setting. To date, however, attempts at automation have failed to deliver satisfactory results.

One previously proposed method of performing automatic valve clearance setting utilizes an automatic machine tool for adjusting the adjustment screw, a linear position sensor which senses the position of the second end of the rocker arm and a linear actuator having a clip member which engages the rocker arm on the second side of the rocker shaft and which is capable of pushing the rocker arm in its valve-actuating direction and pulling the rocker arm in the opposite direction. This method comprises the steps of pushing the second end of the rocker arm in its valve-actuating direction to a predetermined zero position (reference datum) in which the second end of the rocker arm contacts the end of the valve stem but does not displace it from its normally closed position, pulling the rocker arm in the opposite direction by an amount sufficient to remove all backlash from the valve drive train, and adjusting the adjustment screw against the pulling force until the position sensor indicates that the second end of the rocker arm is at a predetermined distance (the required valve clearance) from the zero position. As used herein, "backlash" refers generally to clearances between adjacent, mutually coupled components and is not restricted to clearances between relatively rotatable components. The backlash in the valve drive train additionally includes backlash between the rocker shaft and its mounting pedestals.

This previous method has been found to be unsatisfactory in practice, failing to provide consistently accurate setting of valve clearances. The present inventors have determined that this prior method does not take sufficient account of variations in the relative positions of the various elements of the valve drive train caused by backlash in the valve drive train and movement of the rocker arm during the setting process, and does not take sufficient account of variations in the dimensions of the valve drive train elements between individual valves of an engine and between different engines.

SUMMARY OF THE INVENTION

A method and an apparatus for setting a predetermined clearance in an internal combustion engine between a rocker arm and a rocker arm actuated engine component are disclosed. The rocker arm is rotatably mounted on a rocker shaft for reciprocating movement relative thereto, and the rocker arm has a first end located on a first side of the rocker shaft and a second end located on a second side of the rocker shaft. The first end of the rocker arm has an adjustment screw extending therethrough to act on an end of a push rod. The second end of the rocker arm is movable in a first, component-actuating, direction and in a second direction opposite to the first direction and has a component engaging surface co-operating with a portion of the rocker arm actuated engine component. At least a portion of the rocker arm actuated engine component is biased in the second direction towards a first position and is movable against the bias in the first direction towards a second position.

In one aspect of this invention, a method for setting a predetermined clearance between a rocker arm and a rocker arm actuated engine component comprises the steps of (a) setting the rocker arm to a zero position and recording the zero position as a reference datum; (b) rotating the adjustment screw to adjust the position of the rocker arm to a first reference position; (c) rotating the adjustment screw through a reference angle and recording a corresponding second reference position thereof; (d) calculating a coefficient from the difference between the first and second reference positions and the reference angle; (e) using the coefficient to calculate an angular rotation of the adjustment screw corresponding to the predetermined clearance; and (f) rotating the adjustment screw on the basis of the calculated angular rotation to set the predetermined clearance relative to the reference datum.

In another aspect of this invention, an apparatus for setting a predetermined clearance between a rocker arm and a rocker arm actuated engine component comprises an electronic controller, a rocker arm actuator responsive to the electronic controller to selectively rotate the rocker arm relative to the rocker shaft, a rocker arm position sensor operably connected with the electronic controller to record with the electronic controller the position of the second end of the rocker arm, and an adjustment screw rotator responsive to the electronic controller to selectively rotate the rocker arm adjustment screw. The electronic controller is programmed to (a) a cause the rocker arm actuator to set the rocker arm to a zero position and record the zero position as a reference datum, (b) cause the adjustment screw rotator to rotate the adjustment screw to adjust the position of the rocker arm to a first reference position and then rotate the adjustment screw through a reference angle, (c) record a corresponding second reference position of the rocker arm, (d) calculate a coefficient from the difference between the first and second reference positions and the reference angle, (e) use the coefficient to calculate an angular rotation of the adjustment screw corresponding to the predetermined clearance, and (f) cause the adjustment screw rotator to rotate the adjustment screw on the basis of the calculated angular rotation to set the predetermined clearance relative to the reference datum.

Other features and aspects of this invention will become apparent from following description and accompanying drawings

DETAILED DESCRIPTION

Figure 2:
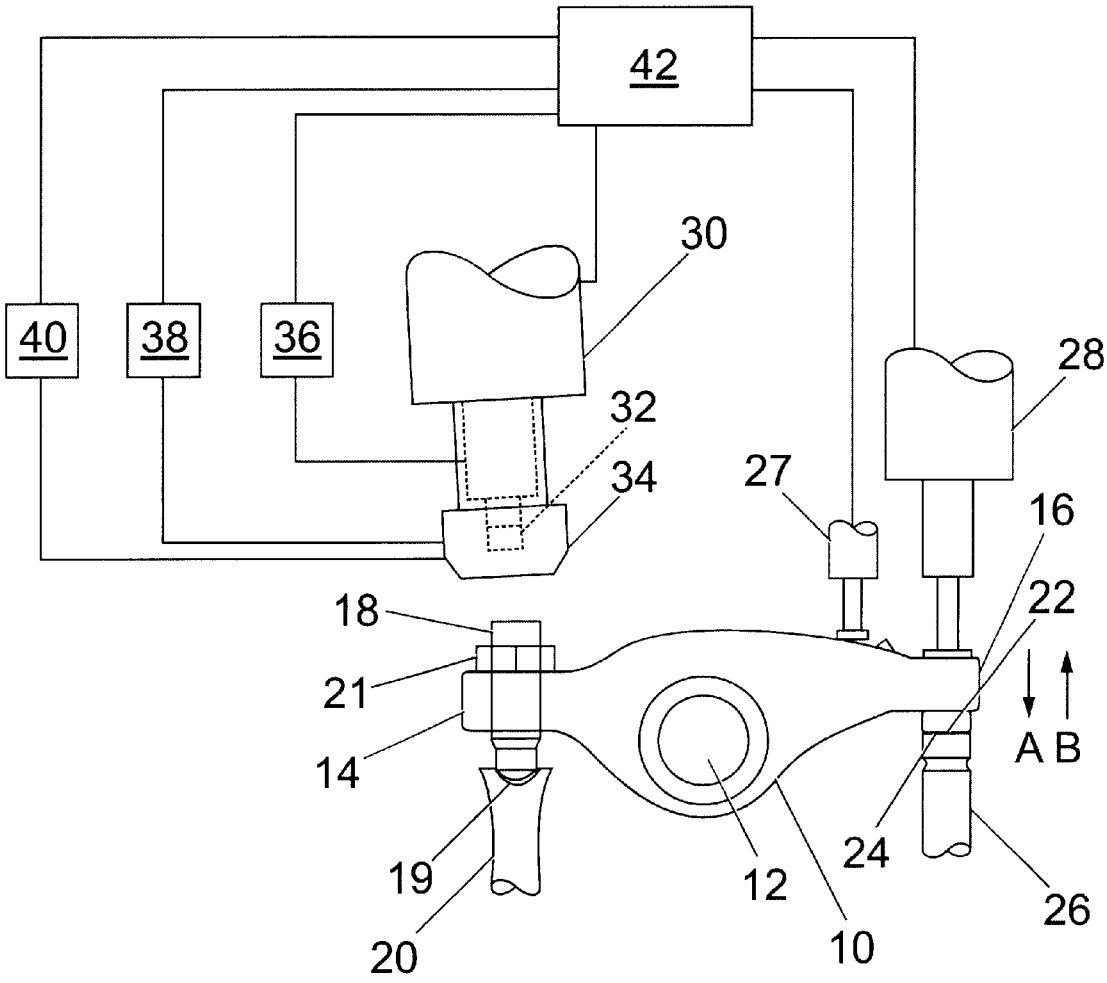
FIG. 2 is a schematic elevational view of part of a rocker arm assembly and an associated valve stem and of components of an automated system for setting the valve clearance in accordance with the preferred embodiment of the present invention.

Referring first to FIG. 2, a rocker arm 10 is rotatably mounted on a rocker shaft 12 for reciprocating movement relative thereto in a first, valve-actuating, direction A and in a second opposite direction B. The rocker arm 10 has a first end 14 located on a first side of the rocker shaft 12 and a second end 16 located on a second side of the rocker shaft 12. The first end 14 of the rocker arm 10 has an adjustment screw 18 extending therethrough and engaging a cup 19 formed in an end of a push rod 20. In this embodiment, the adjustment screw 18 has an associated lock nut 21. It will be understood that if the adjustment screw 18 were a friction screw or the like then the lock nut 21 would not be required. The adjustment screw 18 is rotatable in a first angular direction (clockwise, in this embodiment, for a right hand thread) for downwards movement towards the push rod 20 and in a second angular direction (anti-clockwise, in this embodiment) for upwards movement away from the push rod 20. The second end 16 of the rocker arm 10 has a valve engaging surface 22 co-operating with an end 24 of a valve stem 26 which is resiliently biased in the direction B towards a first position (normally closed) and which is movable towards a second (open) position by rotation of the rocker arm 10 in the first direction A.

For the purposes of performing the method of the present invention, there is provided a rocker arm actuating means, suitably a linear actuator 27 such as a pneumatic cylinder device, adapted to selectively engage the rocker arm 10 on the second side thereof so as to rotate the rocker arm 10 in the first direction A. The linear actuator 27 can be moved in and out of engagement with the rocker arm 10 and is preferably adapted to apply a predetermined force to the rocker arm 10. The linear actuator 27 may be any of a variety of known types and will not be described in detail herein.

Also provided is a position sensing means, suitably a linear position sensor 28, for monitoring the position of the second end 16 of the rocker arm 10. The linear position sensor 28 may be any of a variety of known types and will not be described in detail herein. The sensor 28 should have an accuracy better than the required tolerance of the valve clearance setting, suitably of the order of +/−0.01 mm. The small range of movement of the rocker arm 10 during the valve clearance setting process is such that the arcuate movement of the rocker arm 10 about the rocker shaft 12 may be treated as linear.

Also provided is an adjustment screw actuator means, suitably a machine tool 30, for rotating the adjustment screw 18 in its first and second angular directions. In this embodiment the machine tool 30 has a first, inner rotary actuating element 32 for engaging and rotating the adjustment screw 18 and a second, outer rotary actuating element 34, co-axial with the first element 32, for engaging and rotating the lock nut 21. The first rotary actuating element 32 has associated therewith an angle sensor 36, for measuring the angular rotation of the element 32. The second rotary actuating element 34 has associated therewith a load sensor 38 for measuring the force applied to the lock nut 21 and an angle sensor 40, for measuring the angular rotation of the element 34. The machine tool 30 and its associated sensors may be any of a variety of known types and will not be described in detail herein.

The machine tool 30, linear actuator 27, linear position sensor 28, and the sensors 36, 38 and 40 of the machine tool 30, are connected to a control system 42, such as a digital computer, which provides automatic control of the valve clearance setting process. Control systems of this type are well known in the art and will not be described in detail herein.

The adjustment screw 18 and associated rotary actuator 32 are preferably of the Torx™ head type.

Industrial Applicability

FIGS. 1 and 3A to 3L illustrate the valve clearance setting process, which will now be described in detail.

At the beginning of the process, the relevant piston of the engine is in its top dead center (TDC) position so that the relevant valve is fully closed and the rocker arm 10 is in the correct orientation for the valve clearance setting process. The lock nut 21 is also at a pre-set position on the adjustment screw 18.

Figure 3A:
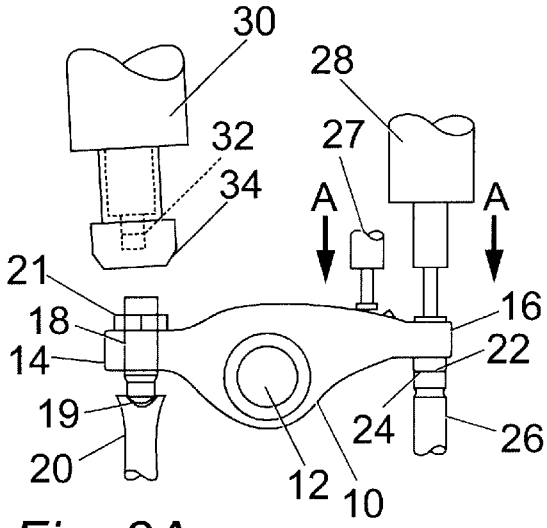
FIGS. 3A to 3L are a series of views similar to that of FIG. 2, illustrating the sequence of operations represented by the graph of FIG. 1.

As shown in FIG. 3A, the linear actuator 27 is engaged on the second side of the rocker arm 10 and operated to apply a predetermined force, less than the resilient bias force urging the valve stem 26 into its first position, to the rocker arm 10 so as to move the rocker arm 10 in the first direction A to a zero position in which the valve engaging surface 22 contacts the end 24 of said valve stem 26 without displacing the valve stem 26 from its first position. This zero position is recorded as a reference datum, using the linear position sensor 28. This is illustrated at point 50 in FIG. 1. At this point the adjustment screw 18 is also shown as having zero degrees of angular rotation.

Figure 3B:
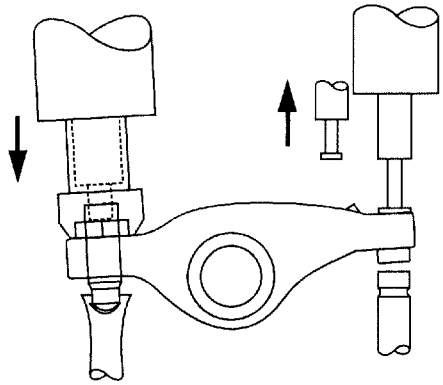

Referring to FIG. 3B, the linear actuator 27 is moved away out of engagement with the rocker arm 10. The machine tool 30 is applied to the adjustment screw 18 and lock nut 21, pushing the adjustment screw 18 into engagement with the cup 19 of the push rod 20 and at the same time displacing the rocker arm 10 and the linear position sensor 28 in the direction B, and eliminating backlash through the push rod 20 and cam follower. At this stage a check may be performed to ensure that the linear position sensor 28 has been displaced in the direction B by a pre-determined minimum value (typically of the order of 0.05 mm); i.e. that there has been a movement of the rocker arm 10. This ensures that the lock nut pre-set was correct.

Figure 3C:
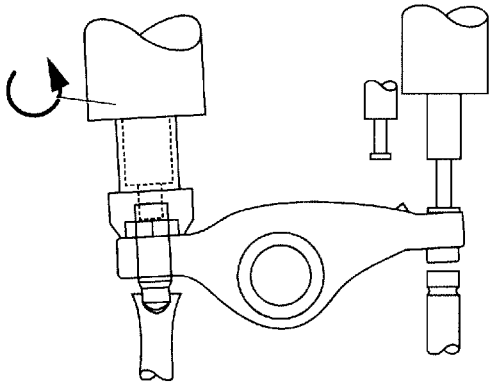

As shown in FIG. 3C, the outer rotary actuator 34 of the machine tool 30 is operated to unfasten the lock nut 21 by one turn, whilst the adjustment screw 18 is held at zero degrees rotation by the inner rotary actuator 32, in order to allow subsequent adjustment of the adjustment screw 18.

Figure 1:
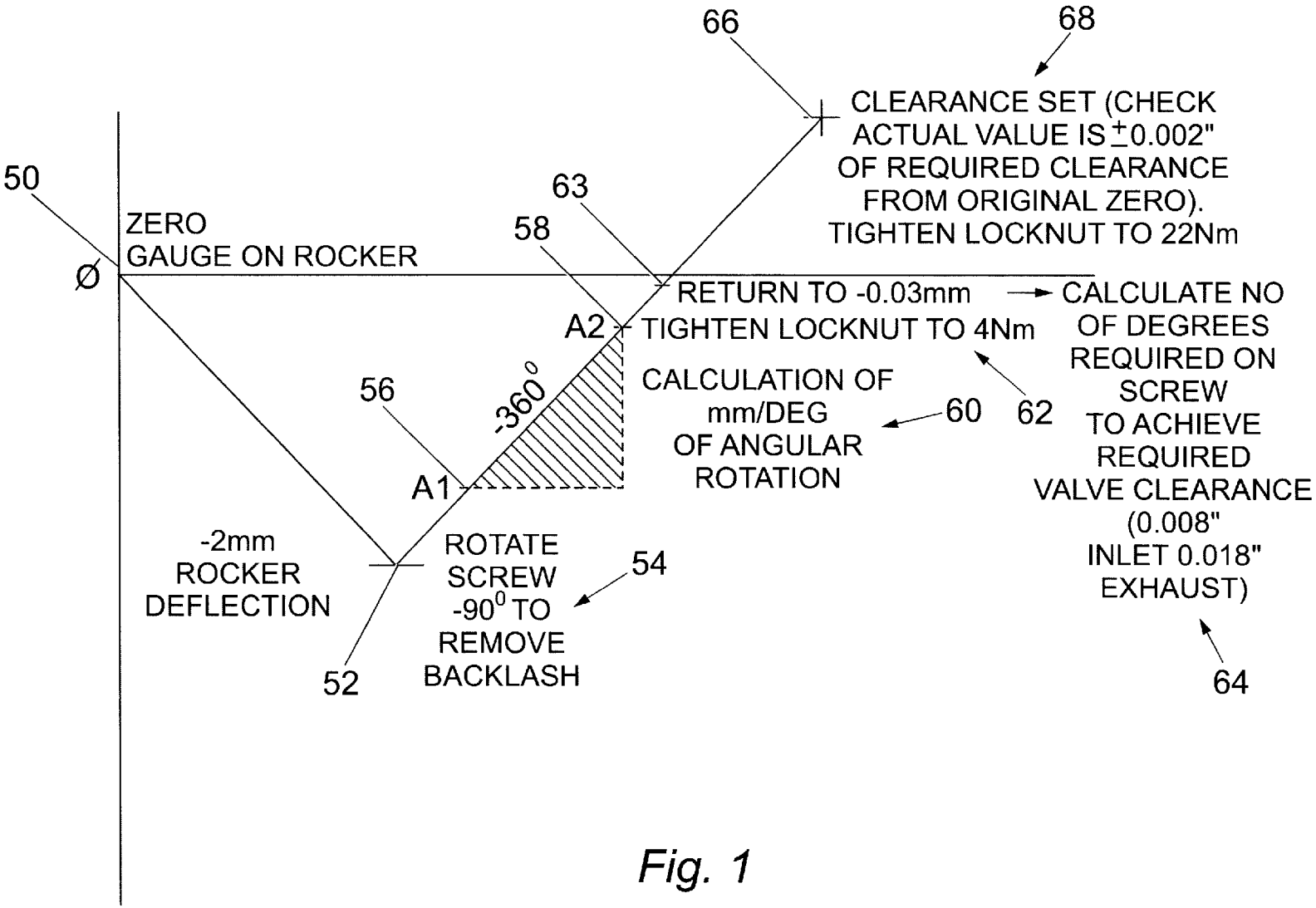
FIG. 1 is a graph showing variations in the position of the second end of a rocker arm against the angle of rotation of a valve adjustment screw while performing a valve clearance setting operation in accordance with a preferred embodiment of the present invention.
Figure 3D:
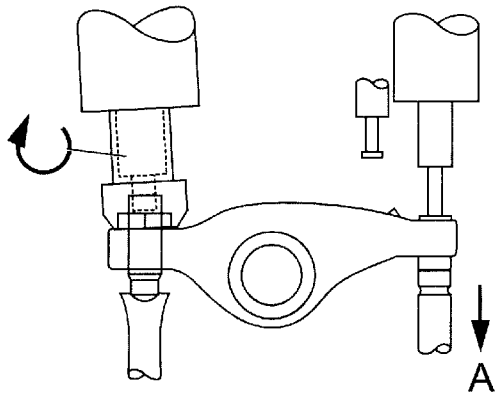

As shown in FIG. 3D, the lock nut 21 is held while the adjustment screw 18 is rotated in its first direction until the linear position sensor 28 indicates a predetermined displacement of the second end 16 of the rocker arm 10 in the direction A, moving the valve stem 26 in the first direction to a third position intermediate its first and second positions (point 52 in FIG. 1.). The predetermined displacement is typically of the order of 2 mm, selected to be greater than or equal to a minimum value sufficient to place the valve drive train in tension with the backlash between the various drive train components biased in one direction. The value is sufficiently small that the arcuate movement of the second end 16 of the rocker arm 10 can be regarded as linear.

Figure 3E:
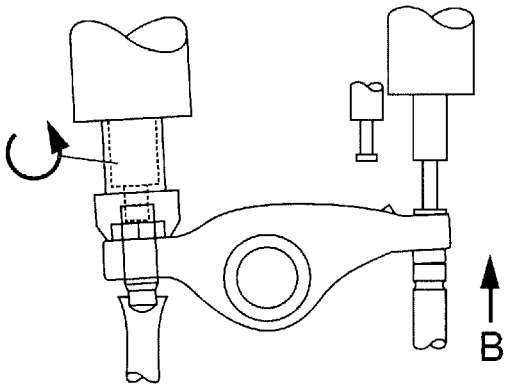

As shown in FIG. 3E, the adjustment screw is then rotated in its second direction through a first predetermined angle, displacing the rocker arm 10 by a small amount in the second direction B (54 in FIG. 1). This predetermined angle, typically of the order of 90 degrees, is selected to be sufficient to neutralize the backlash at least between the rocker arm 10 and rocker shaft 12 and, preferably, between the adjustment screw 18 and the rocker arm 10. Generally speaking, this means that the backlash between the rocker arm 10 and the rocker shaft 12 is shifted in the opposite direction from that caused by the previous displacement of the rocker arm 10 in the direction A, moving the clearance between the rocker arm and rocker shaft from one side of the rocker shaft to the other. This takes the process to point 56 in FIG. 1.

The process described thus far comprises setting a zero position (reference datum) for subsequent measurements of the linear position of the second end 16 of the rocker arm 10 and then adjusting the rocker arm position in such a way as to neutralize backlash affecting the position of the rocker arm which might compromise the accuracy of the subsequent process steps.

Figure 3F:
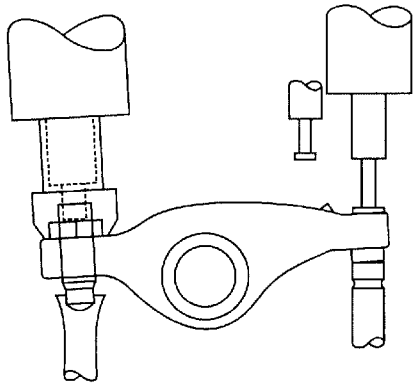
Figure 3G:
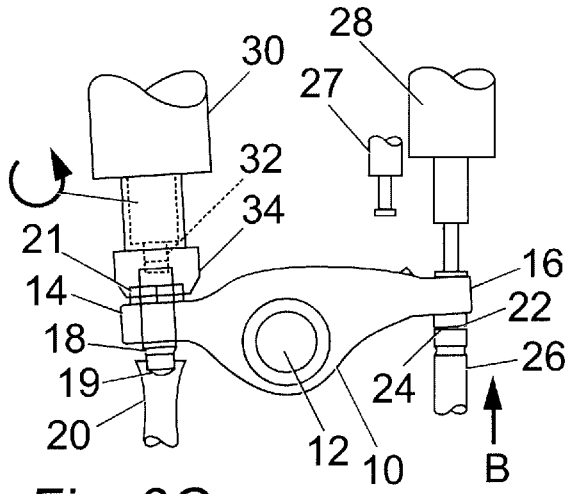
Figure 3H:
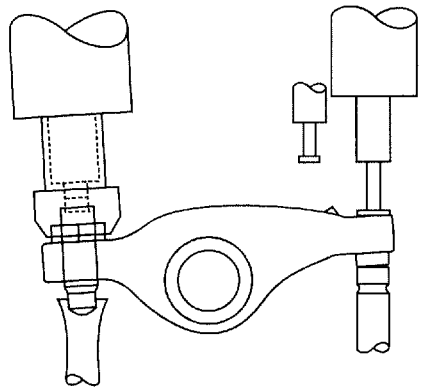
Figure 3I:
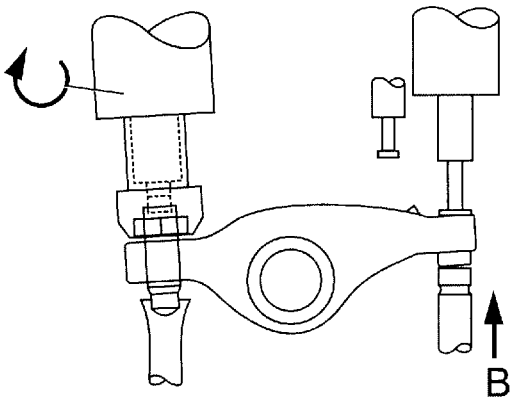
Figure 3J:
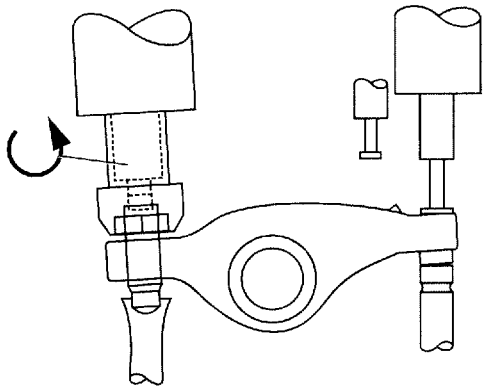

At point 56 in FIG. 1, the linear position of the second end 16 of the rocker arm 10 relative to the zero position is recorded as a first reference position A1 (FIG. 3F). Next (FIG. 3G), the adjustment screw 18 is rotated further in its second direction through a predetermined reference angle θ (suitably 360 degrees) and the corresponding rocker arm position is recorded as a second reference position A2 (point 58 in FIG. 1). Next (FIG. 3H, step 60 in FIG. 1), a coefficient X is calculated as follows:

$$X=(A2-A1)/\theta \text{ mm/degree}$$

i.e. X represents mm of linear movement of the second end 16 of the rocker arm 10 per degree of rotation of the adjustment screw 18, under the neutral backlash conditions established by the preceding adjustments of the rocker arm position. This has the effect of compensating for variables present in the valve drive train, including rocker shaft tolerances etc., and the coefficient X is specific to the particular combination of rocker arm and adjustment screw. This would not be achieved by calculating the value of X from position measurements made without previously adjusting the rocker arm position to neutralize backlash as described or by calculating X directly from the nominal pitch of the adjustment screw 18 or the like.

Next (FIG. 3J, step 62 in FIG. 1), the lock nut 21 is tightened slightly ("snugged") by a predetermined force applied by the machine tool 30. This induces a slight additional movement of the rocker arm 10 in the second direction B. To compensate for this, the adjustment screw 18 is rotated in its second angular direction until the second end 16 of the rocker arm 10 is displaced by a small predetermined correction distance d in the direction A relative to the zero position. The distance d is an arbitrary small value that is just large enough to be measured accurately by the position sensor 28, typically of the order of 0.03 mm (point 63 in FIG. 1). This step is not required if the adjustment screw does not have a lock nut.

Next (FIG. 3J, step 64 in FIG. 1), the angular rotation R of the adjustment screw 18 corresponding to the linear displacement required to set the desired clearance gap C relative to the zero position is calculated as follows:

$$R=(C+d)/X.$$

Typical values of C might be 0.203 mm (0.008 inch) for an inlet valve and 0.457 mm (0.018 inch) for an exhaust valve.

Figure 3K:
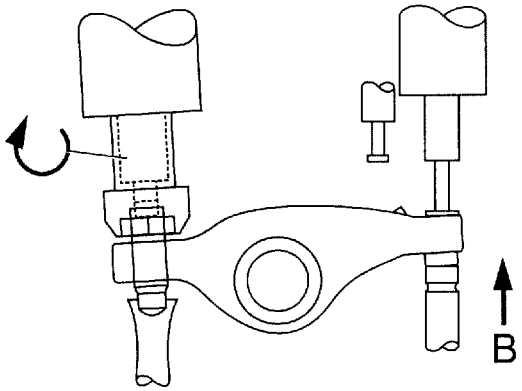
Figure 3L:
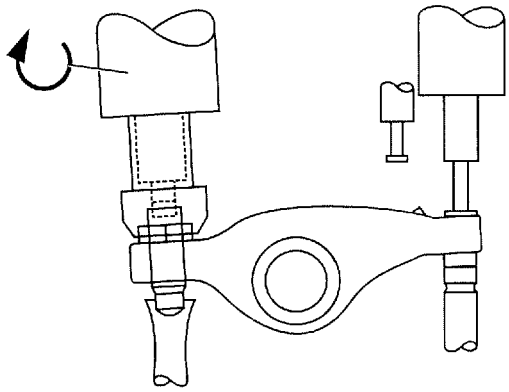

The adjustment screw 18 is then rotated in its second angular direction through the angle R to achieve the desired clearance C between the rocker face 22 and the end 24 of the valve stem 26, thus setting the required valve clearance gap (FIG. 3K, point 66 in FIG. 1). The lock nut 21 is then tightened fully by applying a predetermined force thereto. Finally, the clearance is checked using the linear position sensor 28 to ensure that the clearance is within the required tolerance relative to the zero position (FIG. 3L, point 68 in FIG. 1).

The invention thus provides a method of reliably and accurately setting a valve clearance gap in an automatic process. While this invention has been described in the context of an engine having two valves per cylinder wherein the valves are acted upon directly by the rocker arms, those skilled in the art will recognize that this invention is equally applicable to engines have more than two valves per cylinder in which multiple valves are simultaneously actuated by a single rocker arm that acts upon a connecting structure or so-called "bridge" joining such valves for movement together. Those skilled in the art will also recognize that this invention is applicable to setting the clearance between a rocker arm and any other rocker arm actuated engine component, such as the tappet of a mechanically actuated unit fuel injector for example.

Although the preferred embodiments of this invention have been described herein, improvements and modifications may be incorporated without departing from the scope of the invention.

What is claimed is:

1. A method of setting a predetermined clearance in an internal combustion engine between a rocker arm and a rocker arm actuated engine component, in which a rocker arm is rotatably mounted on a rocker shaft for reciprocating movement relative thereto, the rocker arm having a first end located on a first side of the rocker shaft and a second end located on a second side of the rocker shaft, the first end of the rocker arm having an adjustment screw extending therethrough to act on an end of a push rod, the second end of the rocker arm being movable in a first, component-actuating, direction and in a second direction opposite to said first direction and having a component engaging surface co-operating with a portion of the rocker arm actuated engine component, at least a portion of the rocker arm actuated engine component being biased in said second direction towards a first position and being movable against the bias in said first direction towards a second position, the method comprising the steps of:

(a) setting the rocker arm to a zero position and recording said zero position as a reference datum;

(b) rotating the adjustment screw to adjust the position of said rocker arm to a first reference position;

(c) rotating the adjustment screw through a reference angle and recording a corresponding second reference position thereof;

(d) calculating a coefficient from the difference between said first and second reference positions and said reference angle;

(e) using said coefficient to calculate an angular rotation of the adjustment screw corresponding to said predetermined clearance; and (f) rotating the adjustment screw on the basis of said calculated angular rotation to set the predetermined clearance relative to said reference datum.

2. The method of claim 1 wherein said rocker arm actuated engine component includes an engine valve having a valve stem, and wherein said rocker arm includes a valve engaging surface co-operating with an end of the valve stem.

3. The method of claim 2 wherein the step of setting the rocker arm to said zero position comprises setting the rocker arm to a position in which said valve engaging surface of the rocker arm contacts the end of the valve stem without displacing the valve stem from its first position.

4. The method of claim 1 wherein said rocker arm actuated engine component includes a bridge connecting plural engine valves.

5. The method of claim 1 wherein said rocker arm actuated engine component includes a tappet of a mechanically actuated unit fuel injector.

6. The method of claim 1 wherein said first reference position is a position in which backlash affecting the position of the rocker arm is substantially neutralized.

7. The method of claim 1 wherein step (a) includes moving said rocker arm in said first direction to said zero position.

8. The method of claim 1 wherein the adjustment screw is rotatable in a first angular direction for movement towards the push rod and in a second angular direction for movement away from the push rod, and wherein step (b) includes rotating said adjustment screw in said first angular direction such that said rocker arm is displaced from its first position to a third position intermediate said first and second positions.

9. The method of claim 8 wherein step (b) further includes rotating the adjustment screw in said second angular direction through a predetermined angle such that said rocker arm moves from its third position to a fourth position intermediate said third and first positions.

10. The method according to claim 9 wherein step (c) includes rotating the adjustment screw through said reference angle in said second angular direction such that the rocker arm moves from said fourth position towards said first position.

11. The method of claim 1 wherein the adjustment screw has a lock nut associated therewith, and wherein step (a) includes loosening said lock nut prior to setting the rocker arm to said zero position.

12. The method of claim 11 wherein the lock nut is tightened slightly following step (c) and prior to step (f).

13. The method of claim 12 wherein the lock nut is tightened fully following step (f).

14. The method of claim 12 wherein said angular rotation calculated in step (e) corresponds to said predetermined valve clearance plus a correction distance representing a displacement of the second end of the rocker arm caused by said slight tightening of the lock nut.

15. The method of claim 14 wherein step (f) comprises rotating the adjustment screw such that the second end of the rocker arm is displaced from the zero position in said first direction by said correction distance and the predetermined valve clearance is then set by rotating the adjustment screw through the angular rotation calculated in step (e).

16. An apparatus for setting a predetermined clearance in an internal combustion engine between a rocker arm and a rocker arm actuated engine component, in which a rocker arm is rotatably mounted on a rocker shaft for reciprocating movement relative thereto, the rocker arm having a first end located on a first side of the rocker shaft and a second end located on a second side of the rocker shaft, the first end of the rocker arm having an adjustment screw extending therethrough to act on an end of a push rod, the second end of the rocker arm being movable in a first, component-actuating, direction and in a second direction opposite to said first direction and having a component engaging surface co-operating with a portion of the rocker arm actuated engine component, at least a portion of the rocker arm actuated engine component being biased in said second direction towards a first position and being movable against the bias in said first direction towards a second position, the apparatus comprising:

an electronic controller;

a rocker arm actuator responsive to said electronic controller to selectively rotate the rocker arm relative to the rocker shaft;

a rocker arm position sensor operably connected with said electronic controller to record with said electronic controller the position of the second end of said rocker arm; and an adjustment screw rotator responsive to said electronic controller to selectively rotate the rocker arm adjustment screw;

wherein said electronic controller is programmed to (a) cause said rocker arm actuator to set the rocker arm to a zero position and record said zero position as a reference datum, (b) cause the adjustment screw rotator to rotate the adjustment screw to adjust the position of said rocker arm to a first reference position and then rotate the adjustment screw through a reference angle, (c) record a corresponding second reference position of the rocker arm, (d) calculate a coefficient from the difference between said first and second reference positions and said reference angle, (e) use said coefficient to calculate an angular rotation of the adjustment screw corresponding to said predetermined clearance, and (f) cause said adjustment screw rotator to rotate the adjustment screw on the basis of said calculated angular rotation to set the predetermined clearance relative to said reference datum.

* * * * *